US008496005B2

(12) United States Patent
McDonald et al.

(10) Patent No.: US 8,496,005 B2
(45) **Date of Patent: *Jul. 30, 2013**

(54) BREATHING MASK AND REGULATOR FOR AIRCRAFT

(75) Inventors: Thomas K. McDonald, Overland Park, KS (US); Mark A. Oswald, Shawnee, KS (US); James C. Cannon, Overland Park, KS (US); Bryan N. Rogers, Liberty, MO (US); Raymond P. Feith, Chino Hills, CA (US)

(73) Assignee: BE Aerospace, Inc., Wellington, FL (US)

( * ) Notice: Subject to any disclaimer, the term of this patent is extended or adjusted under 35 U.S.C. 154(b) by 151 days.

This patent is subject to a terminal disclaimer.

(21) Appl. No.: 12/942,001

(22) Filed: Nov. 8, 2010

(65) Prior Publication Data

US 2011/0061655 A1 Mar. 17, 2011

Related U.S. Application Data

(63) Continuation of application No. 11/580,142, filed on Oct. 11, 2006, now Pat. No. 7,836,886.

(60) Provisional application No. 60/725,816, filed on Oct. 11, 2005.

(51) Int. Cl.
*A62B 18/02* (2006.01)

(52) U.S. Cl.
USPC ..... 128/205.25; 137/81.1; 137/907; 137/908; 251/83

(58) Field of Classification Search
USPC ..... 128/204.18, 205.24, 205.25, 206.21, 128/206.12, 204.26, 204.29, 201.28, 202.11, 128/207.12; 137/81.1, 907, 908, 78.5, 523; 251/83

See application file for complete search history.

(56) References Cited

U.S. PATENT DOCUMENTS

| | | | | |
|---|---|---|---|---|
| 3,556,095 | A | 1/1971 | Ismach | |
| 3,690,244 | A | 9/1972 | Kallel et al. | |
| 3,875,957 | A * | 4/1975 | Veit et al. | 137/81.1 |
| 4,018,243 | A | 4/1977 | Dunbar | |
| 4,219,017 | A | 8/1980 | Shamlian et al. | |
| 4,224,938 | A | 9/1980 | Hilal | |
| 4,436,090 | A * | 3/1984 | Darling | 128/204.26 |
| 4,608,976 | A | 9/1986 | Suchy | |
| 4,651,728 | A * | 3/1987 | Gupta et al. | 128/201.28 |
| 4,915,106 | A * | 4/1990 | Aulgur et al. | 128/207.11 |
| 4,919,124 | A * | 4/1990 | Stevenson et al. | 128/202.26 |
| 4,928,682 | A * | 5/1990 | Stevenson et al. | 128/202.26 |
| 5,099,877 | A * | 3/1992 | Fluegel | 137/527.8 |
| 5,199,426 | A * | 4/1993 | Aldworth et al. | 128/205.24 |
| 5,542,447 | A | 8/1996 | Foote et al. | |

(Continued)

FOREIGN PATENT DOCUMENTS

| | | |
|---|---|---|
| GB | 775911 | 5/1957 |
| JP | 61109554 U | 7/1986 |

*Primary Examiner* — Justine Yu
*Assistant Examiner* — Colin W Stuart
(74) *Attorney, Agent, or Firm* — Fulwider Patton LLP

(57) ABSTRACT

The auxiliary breathing flow channel apparatus for an oxygen mask for pilots and crew of an airplane includes a flow control device with closed and open positions to regulate flow through an auxiliary channel. A pressure sensor such as an aneroid capsule automatically closes the auxiliary channel upon a decrease in cabin pressure. A handle also allows a user to manually move the flow regulating means to a closed position.

1 Claim, 9 Drawing Sheets

U.S. PATENT DOCUMENTS 5,645,055 A * 7/1997 Danon ..... 128/204.25
5,664,566 A 9/1997 McDonald et al.
6,789,539 B2 9/2004 Martinez
6,886,559 B2 5/2005 McDonald et al.
6,994,086 B1 2/2006 Martinez et al.
7,584,753 B2 9/2009 Aubonnet et al.
7,836,886 B2 * 11/2010 McDonald et al. ..... 128/205.25
2003/0140971 A1 7/2003 Haunhorst
2004/0261794 A1 12/2004 Patterson et al.
2006/0037653 A1 2/2006 Moreno
2007/0006881 A1 1/2007 Hsieh

* cited by examiner

BREATHING MASK AND REGULATOR FOR AIRCRAFT

CROSS-REFERENCES TO RELATED APPLICATIONS

This application is a continuation of application Ser. No. 11/580,142, filed Oct. 11, 2006, now U.S. Pat. No. 7,836,886, which is based upon Provisional Application No. 60/725,816, filed Oct. 11, 2005, the entire contents of which are incorporated herein by reference.

BACKGROUND OF THE INVENTION

In mask and regulator assemblages known in the art, the mask seals against the user's face. When the user inhales, pressure in the oronasal face seal of the mask is lowered, relative to the ambient surroundings. This relative decrease in pressure causes the mechanism of the regulator to dispense oxygen into the oronasal face seal. In some cases, oxygen and diluting air from the ambient surroundings are jointly dispensed into the oronasal face seal. Regulators that deliver oxygen in response to the user's inhalation are sometimes termed "demand regulators," and those which are able to deliver a mixture of oxygen and diluting air are sometimes termed "diluter-demand regulators." Regulators are sometimes said to be operated in various "modes" such as "demand mode" or "diluter-demand mode." Similar nomenclature is sometimes applied to the combination of mask and regulator, as well.

In various aviation applications using masks with diluter-demand regulators, the regulator must reliably deliver a specified quantity of oxygen when the cabin pressure altitude is at 10,000 ft. It is very difficult and impractical to design a conventional regulator so that the required quantity of oxygen is delivered at 10,000 ft, but no oxygen is delivered at slightly lower pressure altitudes where the ambient pressure is only slightly higher, such as approximately 5,000 to 8,000 ft cabin pressure altitude.

This difficulty is particularly acute in regulators that are designed in a sufficiently compact and light weight package to render them practical to be mounted directly on the user's oxygen mask.

Further, it is very difficult and impractical to design a conventional regulator with very low inhalation resistance in a sufficiently compact and light weight package to render it practical to be mounted directly on the user's oxygen mask. Thus, it is difficult or impractical to alleviate the increased work of breathing and resulting fatigue and discomfort of the user. It would also be desirable to provide an improved oxygen breathing mask that allows a relative decrease in pressure in the mask to trigger a regulator to dispense oxygen into the oronasal face seal of the mask, but that at the same time avoids unnecessary oxygen usage when the mask is worn but the supply of oxygen is not required, in order to conserve the oxygen supply.

The present invention addresses and solves these and other problems associated with oxygen mask pressure regulators which must operate both above and below 10,000 ft.

SUMMARY OF THE INVENTION

The present invention provides a system for allowing long duration wearing of the crew mask with minimal or no consumption of oxygen at cabin altitudes below 10,000 ft in non-emergency situations.

The present invention is an improved breathing mask and regulator for pilots and crew of an airplane. It is an improvement over the diluter-demand regulators currently employed.

In various operational scenarios, a flight crew sometimes is required to wear oxygen masks, even though the cabin is normally pressurized. Conventional masks and their regulators deliver oxygen under such conditions. This results in increased oxygen consumption. In addition, the breathing resistance connected with conventional masks and regulators leads to a degree of discomfort and fatigue when the equipment is used for extended periods.

In this invention, which can be applied to demand and diluter-demand regulators, the mask and regulator comprise an additional flow channel through which ambient air can be inhaled by the user. This channel has sufficiently low pressure drop such that normal inhalation by the user does not trigger the regulator to dispense stored oxygen.

In a first presently preferred embodiment, the additional flow channel may be configured so that it can be manually opened when the user desires to utilize this feature. It may be manually closed if the user encounters a condition such that it is desirable to operate the mask and regulator in one of its usual operating modes. The additional channel may be further configured such that it is closed automatically when the cabin pressure altitude reaches a predetermined set point, typically a pressure altitude of approximately 10,000 ft, at which point the mask and regulator operation automatically reverts to one of its usual operating modes.

The first embodiment of the present invention accordingly provides for an auxiliary channel, such that ambient air can enter the oronasal face seal of the oxygen mask without producing sufficient reduction of pressure inside the oronasal face seal to cause the regulator to dispense oxygen. A means is supplied to regulate flow through the auxiliary channel, the regulating means having at least a first (closed) position in which flow is blocked and a second (open) position in which flow is enabled. A biasing force is applied to the flow regulating means to maintain it in the first (closed) position, such that the channel is normally blocked. The user may manually move the flow regulating means into the second (open) position, where a latching means is deployed that can capture and retain the flow regulating means in the second (open) position. The user may subsequently manually release the latching means when desired, allowing the flow regulating means to revert to the first (closed) position. A pressure sensing means also is deployed, such that the pressure sensing means can automatically release the latching means upon a decrease in cabin pressure (increase in cabin pressure altitude), allowing the flow regulating means to revert automatically to the first (closed) position without intervention or action by the user upon such a decrease in cabin pressure.

In the first preferred embodiment of the invention, the auxiliary channel is a passage directly through the oronasal face seal of the mask, which entirely bypasses the regulator. By opening a passage in the oronasal face seal versus through the regulator, it is possible to obtain the benefits of the present invention while simultaneously continuing to utilize an existing regulator design, otherwise in accordance with the prior art.

In a presently preferred aspect, the flow regulating means is a valve assembly that opens and shuts by a linear or curvilinear motion of a sliding member, and the biasing force is provided by a pressure sensing means that is compressed when the sliding member is slid into the open position, and relaxes when the sliding member reverts to the closed position.

In another preferred aspect, the flow regulating means is a rotating disk with a hole that can be positioned to overlap another hole in the oronasal face seal of the mask to enable flow, or can be rotated to an alternate alignment so that the holes do not overlap to prevent flow. The biasing force is supplied by a torsion spring, deployed so that the spring will rotate the disk into a closed position.

Because the invention adds an additional channel to the mask and regulator through which ambient air can be inhaled, during normal breathing through the mask the regulator does not deliver oxygen, avoiding unnecessary oxygen usage. Since during normal breathing the inhalation resistance through the added channel is relatively low, as is necessary to avoid triggering release of oxygen by the regulator, the user also experiences less breathing effort, resulting in reduced fatigue and improved user comfort during extended intervals of use in a normally pressurized cabin environment. When needed, a flow of oxygen will be supplied by the regulator, such as when triggered by the user taking a quick breath or engaging in rapid breathing, for example.

In a further preferred aspect, the pressure sensing means may be an aneroid capsule that changes in length in response to the changes in cabin pressure, and the change in length can actuate a linkage that releases the flow regulating means.

In still another preferred aspect, the pressure sensing means is an electronic pressure transducer that is interfaced to a suitable electronic circuit that can release the latching means through the operation of an electrical or electronic actuating means.

In one aspect of the invention, the electrical actuating means may be a solenoid that releases a mechanical catch, allowing the flow regulating means to revert to its closed position.

In another aspect, the electrical actuating means is a coil that is energized briefly to create a magnetic field that overcomes the field of a permanent magnet to release a magnetic catch, allowing the flow regulating means to revert to its closed position.

In a second preferred embodiment, the invention provides for an auxiliary breathing flow channel apparatus for an oxygen mask for pilots and crew of an airplane, the oxygen mask having an oronasal face seal defining an oronasal cavity, and an oxygen supply regulator, wherein an auxiliary air flow channel is defined in a flow channel member through a portion of the oxygen mask. The auxiliary breathing flow channel apparatus includes flow regulating means for regulating flow through the flow channel member. The flow regulating means is movable between at least one closed position in which flow through the air flow channel is blocked and an open position in which flow through the air flow channel is enabled. The flow regulating means includes an aneroid capsule that changes in length in response to changes in cabin pressure operative to move the flow regulating means between the at least one closed position and the open position. The auxiliary breathing flow channel apparatus also includes means for manually moving the flow regulating means to the at least one closed position.

In one presently preferred aspect, the auxiliary air flow channel passes through the oronasal face seal of the mask, bypassing the oxygen supply regulator. In another presently preferred aspect, the flow regulating means includes a main housing defining an inner chamber with an upper opening, lower exit ports, and a lower opening; an upper aneroid housing having a wall and a top cover plate joined to the tubular wall; and a lower aneroid housing disposed in the inner chamber of the main housing and slidingly mated to the upper aneroid housing. An annular ball track insert is disposed between the upper aneroid housing and the lower aneroid housing, with the inner surface of the ball track insert including a lower ball track or groove and an upper ball track or groove, and the tubular wall of the upper aneroid housing includes a plurality of ball apertures, each receiving and retaining a corresponding detent ball. A spring retainer is disposed within the upper aneroid housing and lower aneroid housing, with the spring retainer having a base portion with a plurality of spring fingers connected to and extending from the base portion. The spring fingers each have a protrusion aligned with and disposed adjacent to the detent balls to press against and bias the detent balls outwardly into either of the upper or lower ball tracks to latch the upper aneroid housing in an upper or lower position. The top cover plate preferably includes a plurality of upper vent openings through which ambient air may flow into the auxiliary breathing flow channel to the lower exit ports.

The aneroid capsule is preferably disposed within the upper aneroid housing and lower aneroid housing, and the base portion of the spring retainer is connected to a bottom surface of the aneroid capsule, so that when the aneroid capsule expands at elevated altitudes, the bottom surface of the aneroid capsule moves downwardly and the spring fingers of the spring retainer correspondingly are pushed downwardly by the lengthening of the aneroid capsule, releasing pressure on the detent balls to release the detent balls from the lower track of the ball track in the open position of the auxiliary breathing flow channel, and allowing the detent balls to move to the upper track of the ball track in the closed position of the auxiliary breathing flow channel. The lower aneroid housing preferably includes a lower outer flange and a channel for receiving and retaining an o-ring located adjacent to the lower inner wall of the main housing, and the lower inner wall of the main housing tapers inwardly to form a valve seating surface.

In another presently preferred aspect, the main housing includes an outer threaded flow channel connector, and a flow channel connector flange, threadably connectable to a corresponding threaded mask connector port at a side opening of an oxygen mask oronasal face seal. An o-ring sealing gasket is preferably interposed between the mask connector port and the flow channel connector flange to provide a secure leak proof attachment of the auxiliary breathing flow channel apparatus to the threaded mask connector port of the oxygen mask oronasal face seal.

In another presently preferred aspect, the aneroid capsule includes an aneroid set point screw adjustably mounted in an upper portion of the aneroid capsule for adjusting operation of the aneroid capsule. In another presently preferred aspect, a main coil spring is mounted about the lower aneroid housing between the lower flange and the top cover plate, and a push/pull button is provided, having a generally tubular open lower portion and an upper plate connected to the lower portion, with the push/pull button mounted with the tubular lower portion situated between the upper aneroid housing and the lower aneroid housing, and abutting the upper surface of the ball track insert. In another aspect, the auxiliary breathing flow channel apparatus typically further includes a flapper valve secured below the lower exit ports by a flapper valve retainer.

From the above, it can be seen that the present invention provides important benefits over presently available aircraft oxygen masks. In particular, the invention makes oxygen masks that must be used for long periods during which the cabin pressure can vary to be above and below the equivalent of approximately 10,000 ft more comfortable and less likely to increase the work of breathing and fatigue. An additional benefit to the invention is to reduce oxygen consumption over extended use of the masks compared to conventional oxygen masks. These and other advantages of the invention will be evident to those skilled in the art from the detailed description and drawings below, which illustrate, by way of example, the features of the invention.

DETAILED DESCRIPTION OF THE PREFERRED EMBODIMENTS

Figure 1:
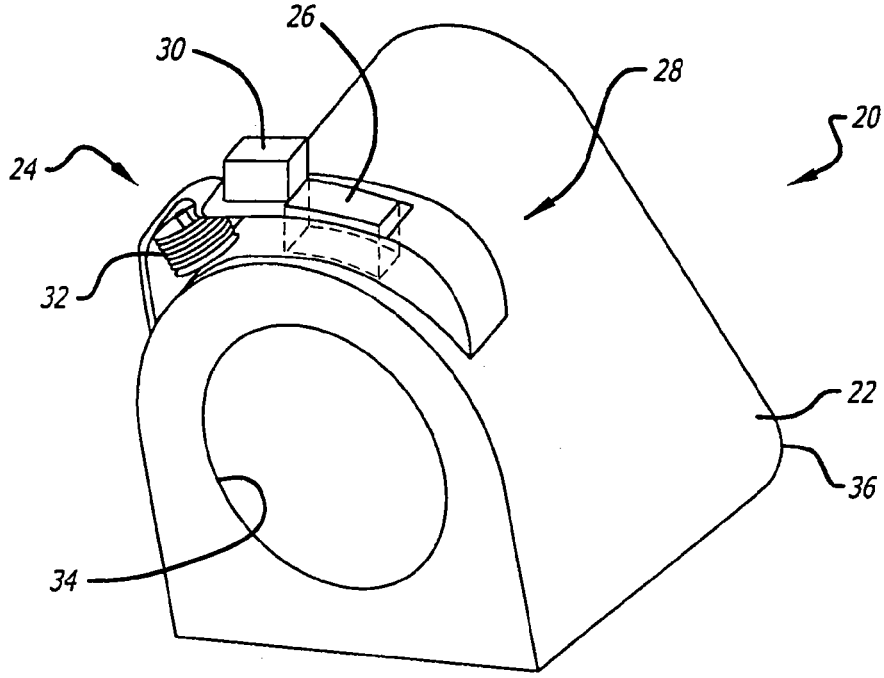
FIG. 1 is a perspective view of a first preferred embodiment of the auxiliary breathing flow channel apparatus of the invention, deployed on an oronasal face seal component of an oronasal face seal of an oxygen mask.

While conventional mask and oxygen regulator assemblies are commonly designed to deliver oxygen when the cabin pressure altitude is at or above approximately 10,000 ft., it has been very difficult and impractical to provide a conventional regulator that will provide the required quantity of oxygen to be delivered at or above approximately 10,000 ft, but will also conserve oxygen by providing no oxygen at slightly lower pressure altitudes where the ambient pressure is only slightly higher, such as approximately 5,000 to 8,000 ft cabin pressure altitude. It has also heretofore been very difficult and impractical to mount a compact and light weight regulator with very low inhalation resistance that must operate above and below 10,000 ft directly on the user's oxygen mask.

The present invention accordingly provides for an auxiliary breathing flow channel apparatus for an oxygen mask for pilots and crew of an airplane, the oxygen mask having an oronasal face seal defining an oronasal cavity, and an oxygen supply regulator. In a first presently preferred embodiment, illustrated in FIG. 1, the auxiliary breathing flow channel 20 may be deployed in an oronasal face seal 22 of an oxygen mask. The oronasal face seal of the oxygen mask typically defines an oronasal cavity, and the oxygen mask typically also includes a regulator, such as a dilution demand regulator, connected by oxygen supply lines to an oxygen supply source, which is typically triggered to dispense oxygen to the oxygen mask in response to sensing of a pressure drop, indicating a demand inhalation, as will be explained further below.

The auxiliary breathing flow channel includes an air flow regulating means 24 having an open position typically at lower altitudes having adequate oxygen levels not requiring the supply of auxiliary oxygen, and a closed position which may be activated automatically at higher altitudes by the air flow regulating valve mechanism, or manually by the user. An air flow channel 26 is defined through a portion of the oxygen mask, such as through the oronasal face seal of the mask, bypassing the oxygen supply regulator. The air flow regulating means includes a valve mechanism 28 for regulating flow through the air flow channel, and the flow regulating means is movable between at least one closed position in which flow through the air flow channel is blocked and an open position in which flow through the air flow channel is enabled. As is illustrated in FIG. 1, the valve mechanism may include a valve assembly that opens and shuts by movement of a sliding member 30, such as by a linear or curvilinear motion of the sliding member. The valve mechanism preferably includes biasing means for applying a biasing force to the flow regulating means to bias the flow regulating means in a closed position, such that the air flow channel is normally blocked. The biasing means typically is compressed when the sliding member is slid into the open position, and relaxes when the sliding member reverts to the closed position. Alternatively, the flow regulating means may include a rotating disk with a hole that can be positioned to overlap another hole in the oronasal face seal of the mask to enable flow, and that can be rotated to an alternate alignment so that the holes do not overlap, to prevent flow. Means for biasing the rotating disk in a closed position, such as a torsion spring, deployed so that the spring will rotate the disk into a closed position, may also be provided. The valve mechanism may also include means for manually moving the flow regulating means into the open position, latching means for releasably retaining the flow regulating means in the open position, and means for releasing the latching means to allow the flow regulating means to revert to the closed position. The biasing means may be a pressure sensing means for sensing ambient pressure, connected to the latching means and operative to release the latching means upon sensing of a decrease in cabin pressure to a threshold pressure, to allow the flow regulating means to revert to the closed position without intervention or action by the user upon such a decrease in cabin pressure. In one presently preferred aspect, the pressure sensing means is an aneroid capsule 32 that changes in length in response to the changes in cabin pressure, and the change in length can actuate a linkage that releases the flow regulating means. As the cabin altitude increases, the aneroid capsule expands, tripping a mechanism that automatically closes the auxiliary flow channel. The pressure sensing means may be an electronic pressure transducer that is interfaced to a suitable electronic circuit that can release the latching means through the operation of an electrical or electronic actuating means, such as a solenoid that releases a mechanical catch, allowing the flow regulating means to revert to its closed position. Alternatively, the electrical actuating means may be a coil that is energized briefly to create a magnetic field that overcomes the field of a permanent magnet to release a magnetic catch, allowing the flow regulating means to revert to its closed position.

When the valve mechanism is in an open position, ambient air can be inhaled through the auxiliary breathing flow channel by the user, allowing normal breathing at lower altitudes having breathable, life-supporting oxygen levels. In the orientation illustrated in FIG. 1, an existing regulator currently employed by B/E Aerospace can interface to the opening 34 in front, while the remainder of the face seal would project to the back 36 of the component shown. Alternatively, the auxiliary channel may be integrated into the structure of a regulator that is adapted to be attached to an oxygen mask. This allows the improved regulator to be installed on an otherwise unmodified mask of the prior art. The auxiliary breathing flow channel has a sufficiently low pressure drop that normal inhalation by the user does not trigger the regulator to dispense stored oxygen. Thus, the invention can be incorporated into the equipment design while eliminating or minimizing the need to modify the designs of other elements of the equipment that are otherwise satisfactory.

Figure 4:
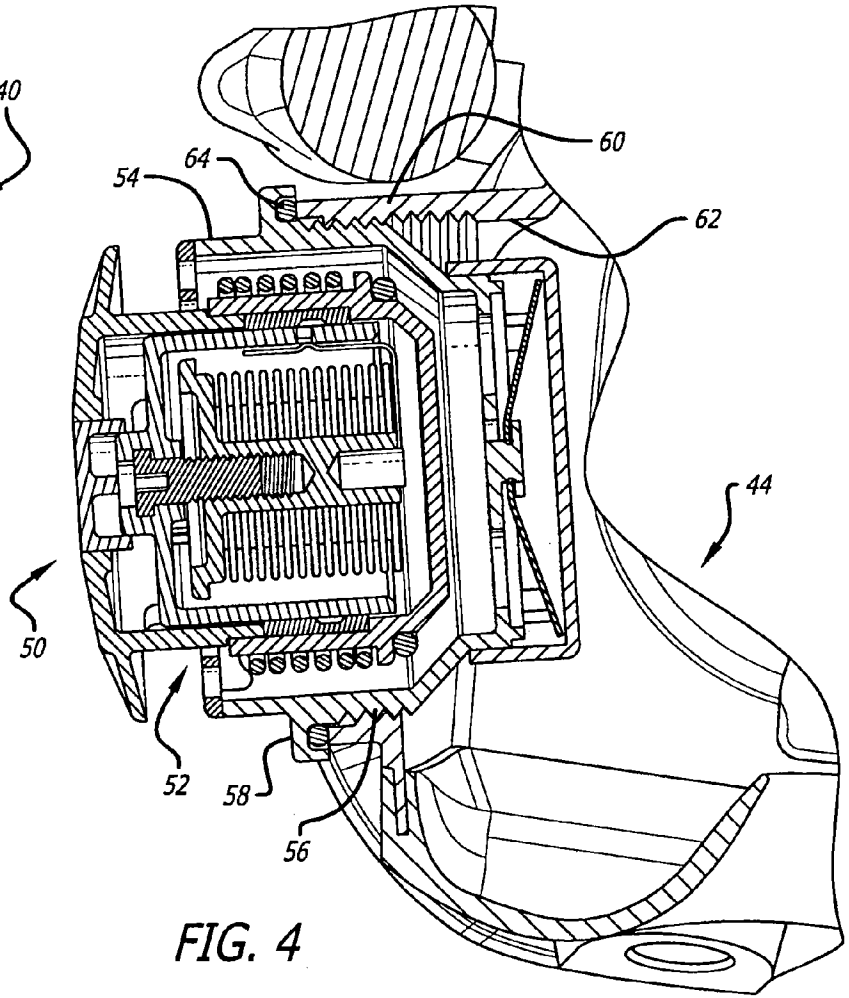
FIG. 4 is a cross-sectional view of the oxygen mask and auxiliary breathing flow channel apparatus taken along line 4-4 of FIG. 3.

In a second presently preferred embodiment, illustrated in FIGS. 2-18, the auxiliary breathing flow channel may be deployed in an oxygen mask 40, typically having an oronasal face seal 42 defining an oronasal cavity 44, a portion of which is illustrated in FIG. 4, and a regulator 48, such as a dilution demand regulator, connected by one or more oxygen supply lines 49 to an oxygen supply source (not shown), which is typically triggered to dispense oxygen to the oxygen mask in response to sensing of a pressure drop, indicating a quick or rapid breathing, or high altitude with a low oxygen level has been reached.

Figure 2:
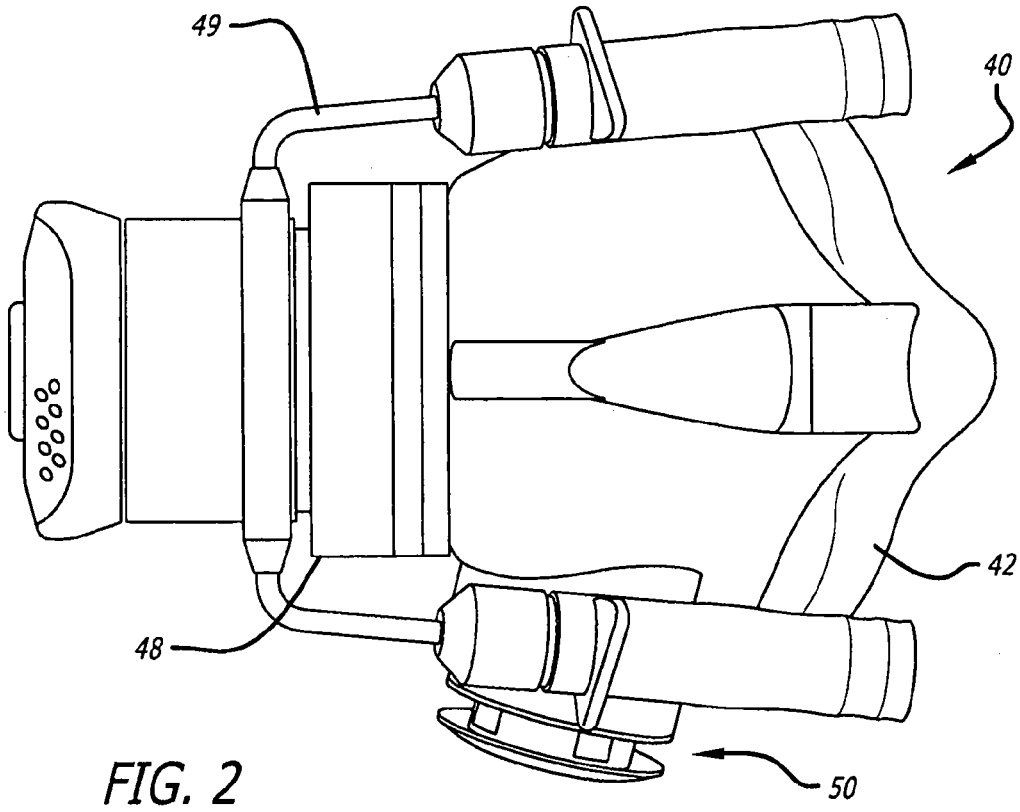
FIG. 2 is a top plan view of an oxygen mask showing a second preferred embodiment of the auxiliary breathing flow channel apparatus of the invention, deployed in an oronasal face seal of the oxygen mask.
Figure 3:
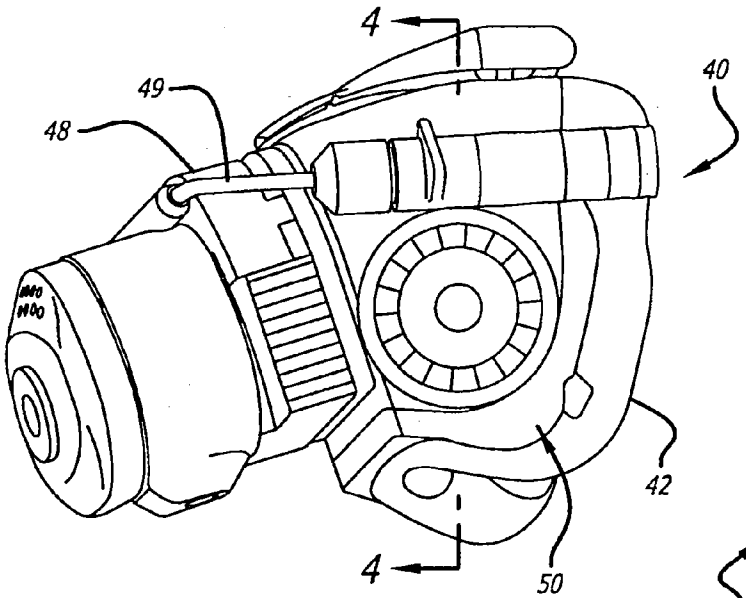
FIG. 3 is a side perspective view of the oxygen mask and auxiliary breathing flow channel apparatus of FIG. 2.
Figure 5:
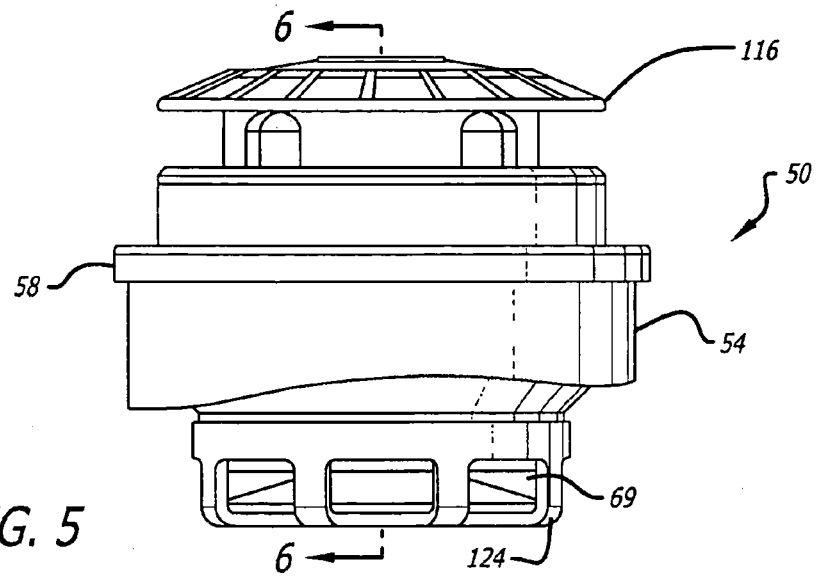
FIG. 5 is an elevational view of the auxiliary breathing flow channel apparatus of FIG. 2, shown in a valve open position.
Figure 6:
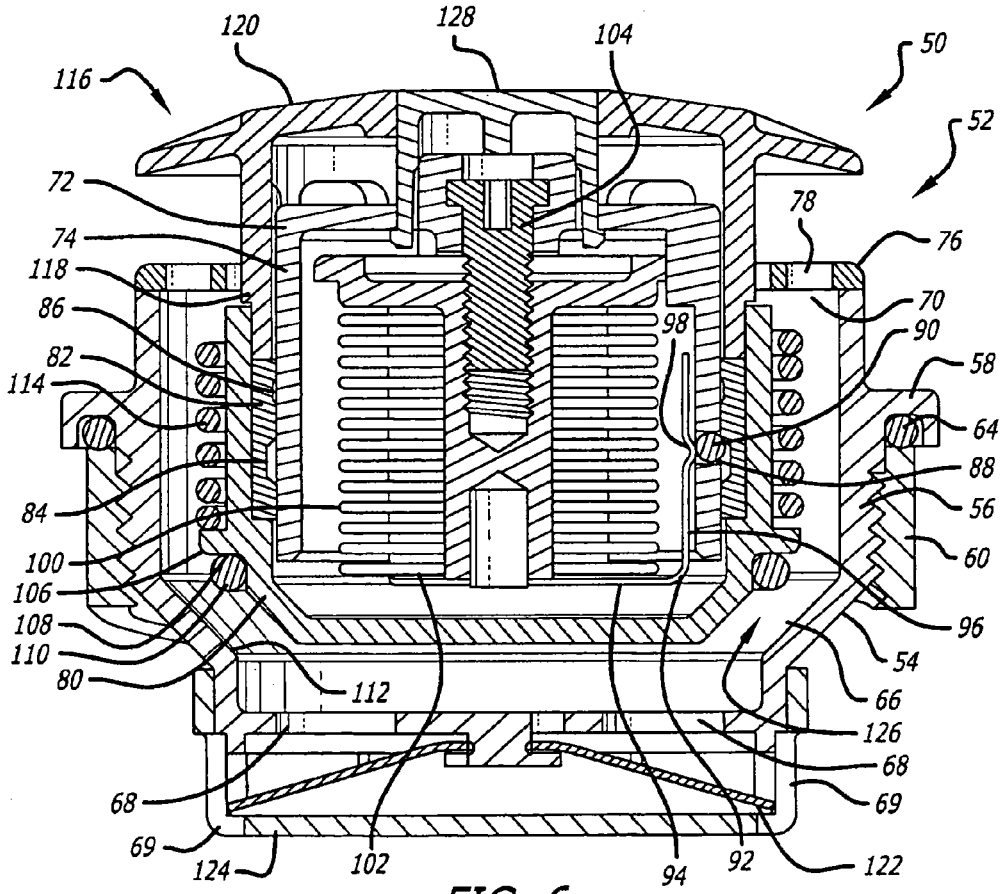
FIG. 6 is a cross-sectional view of the auxiliary breathing flow channel apparatus taken along line 6-6 of FIG. 5.
Figure 7:
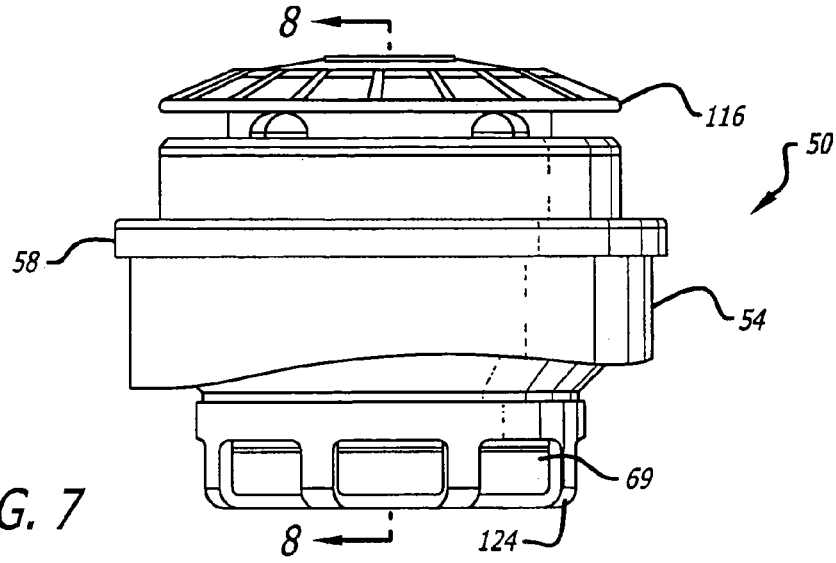
FIG. 7 is an elevational view of the auxiliary breathing flow channel apparatus of FIG. 2, shown in a valve closed position.
Figure 8:
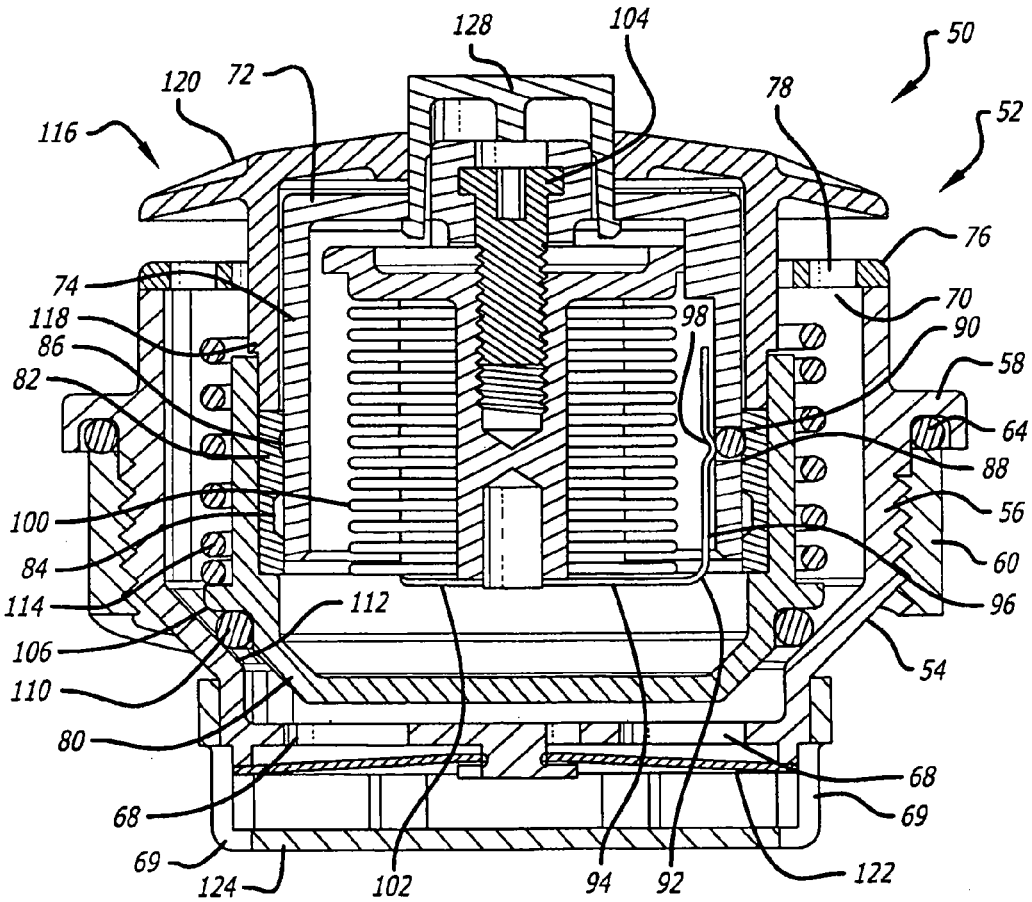
FIG. 8 is a cross-sectional view of the auxiliary breathing flow channel apparatus taken along line 8-8 of FIG. 7.
Figure 9:
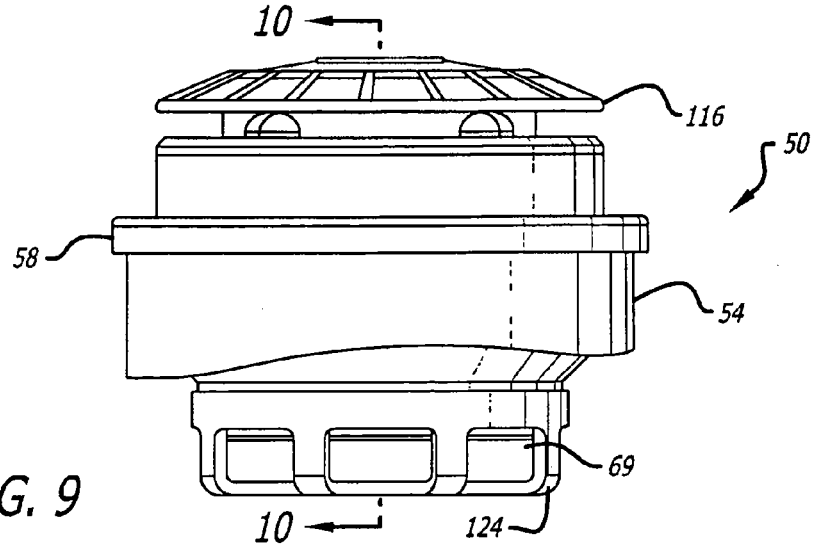
FIG. 9 is an elevational view of the auxiliary breathing flow channel apparatus of FIG. 2, shown in a valve manually closed position.
Figure 10:
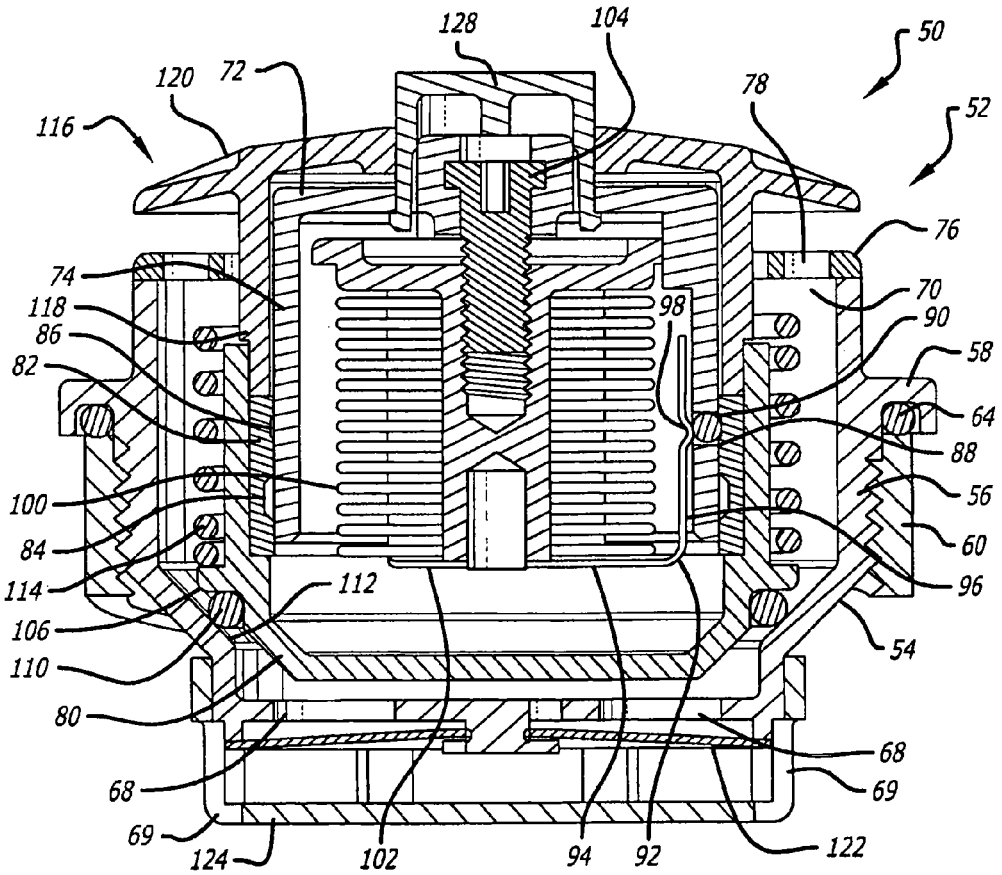
FIG. 10 is a cross-sectional view of the auxiliary breathing flow channel apparatus taken along line 10-10 of FIG. 9.
Figure 12:
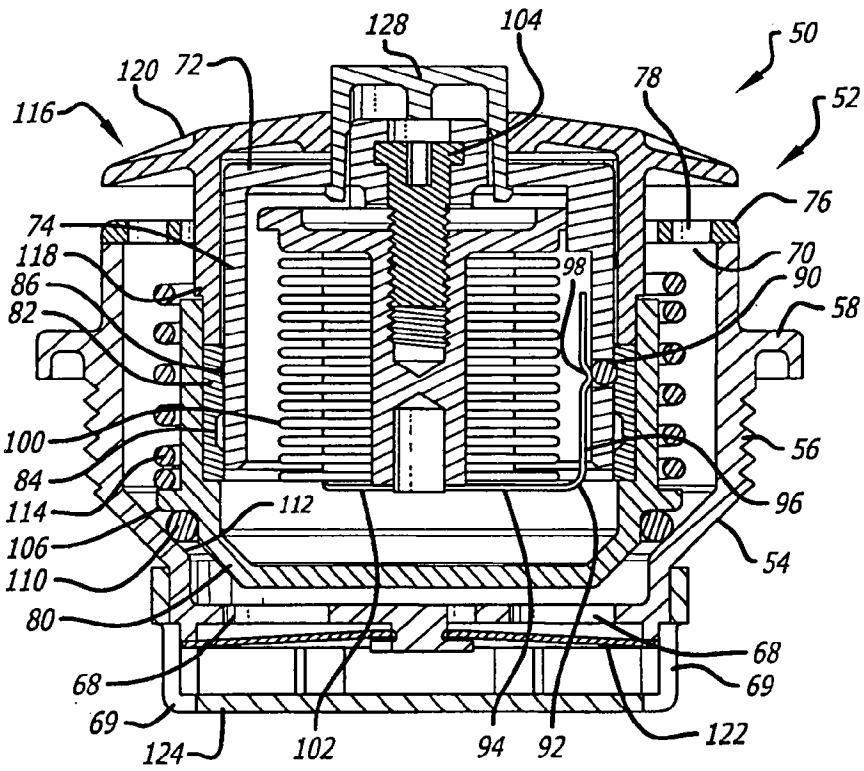
FIG. 12 is another cross-sectional view of the auxiliary breathing flow channel apparatus of FIG. 2 shown in the valve closed position.
Figure 11:
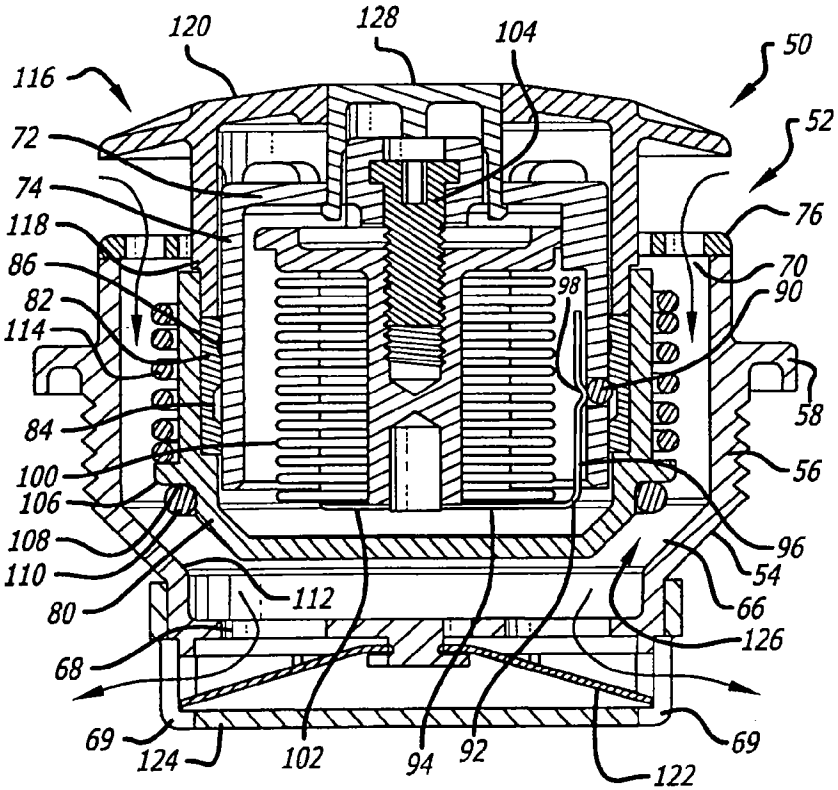
FIG. 11 is a cross-sectional view of the auxiliary breathing flow channel apparatus shown in the valve open position and showing the flow path through the apparatus of FIG. 2.
Figure 14:
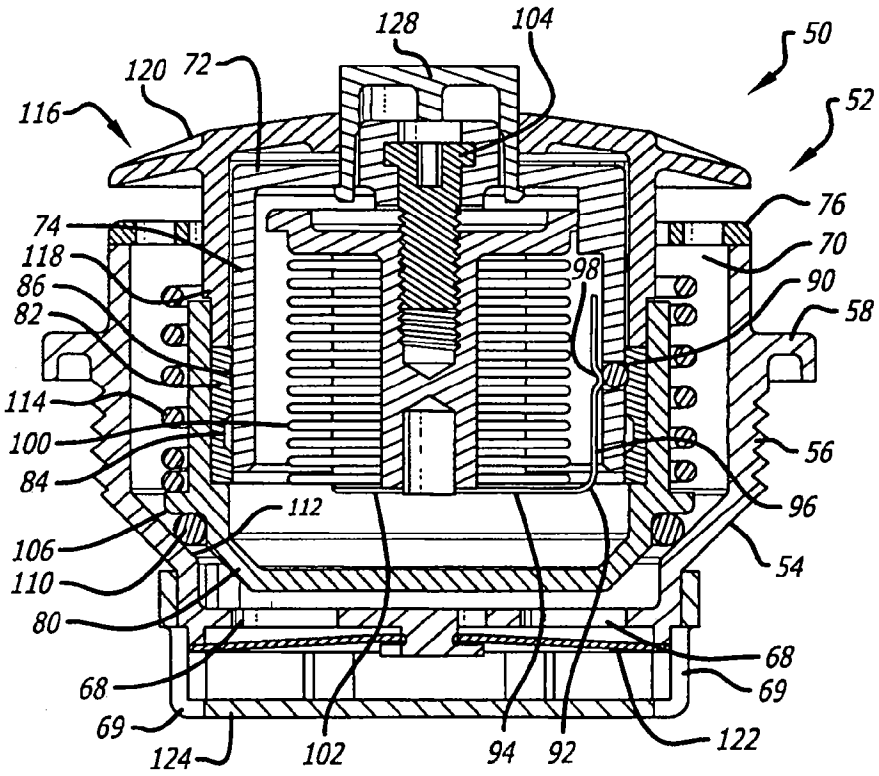
FIG. 14 is another cross-sectional view of the auxiliary breathing flow channel apparatus of FIG. 2 shown in the valve manually closed position.
Figure 13:
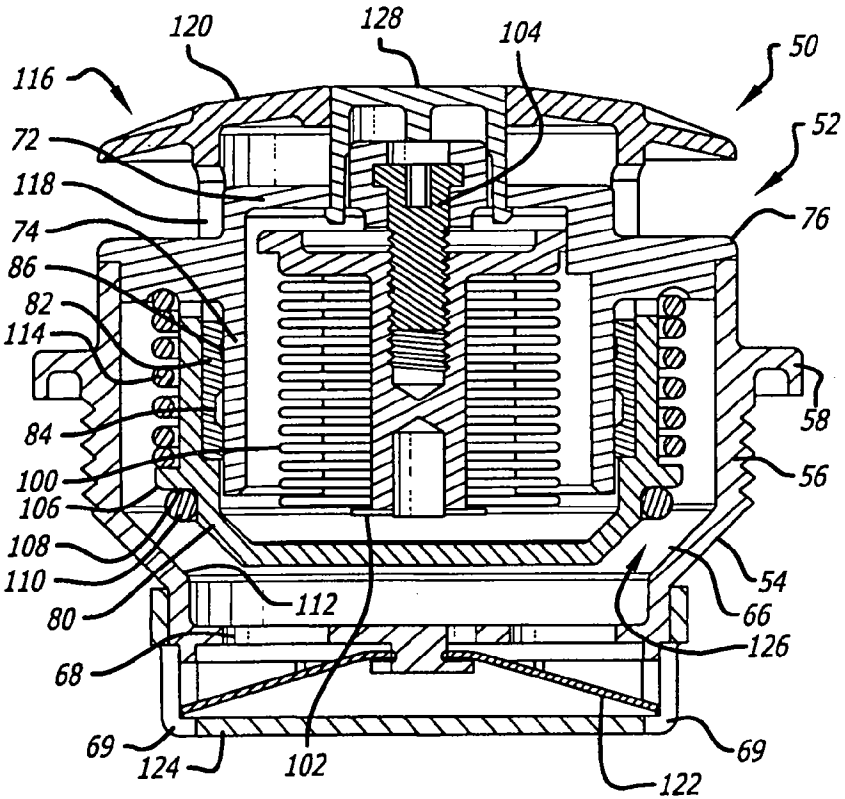
FIG. 13 is another cross-sectional view of the auxiliary breathing flow channel apparatus of FIG. 2 shown in the valve open position showing the top cover plate.
Figure 17:
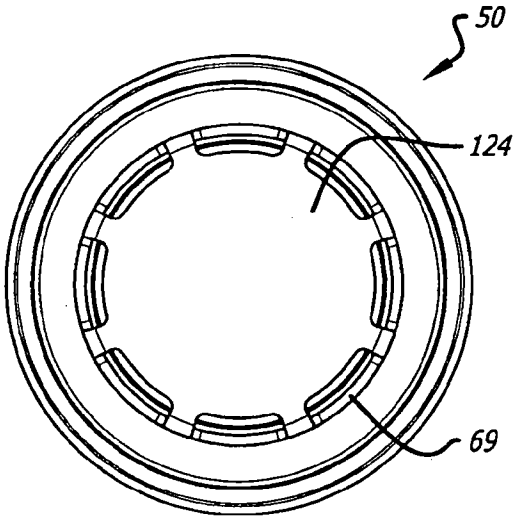
FIG. 17 is a bottom plan view of the auxiliary breathing flow channel apparatus of FIG. 2.
Figure 16:
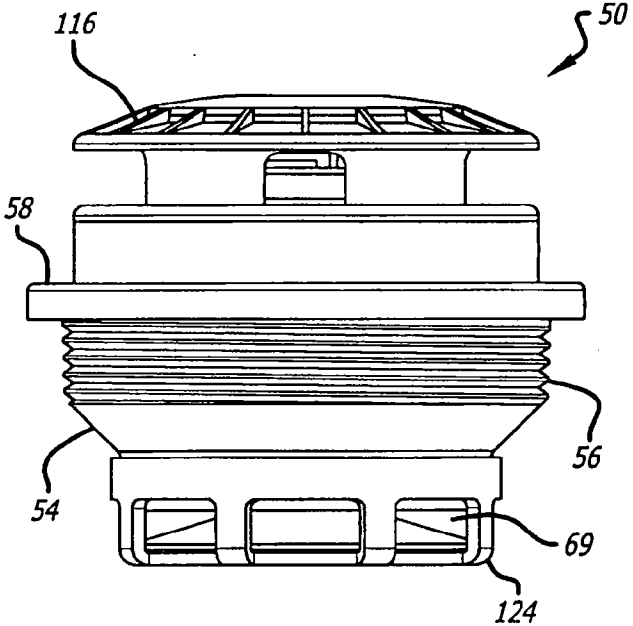
FIG. 16. is a side elevational view of the auxiliary breathing flow channel apparatus of FIG. 2.
Figure 15:
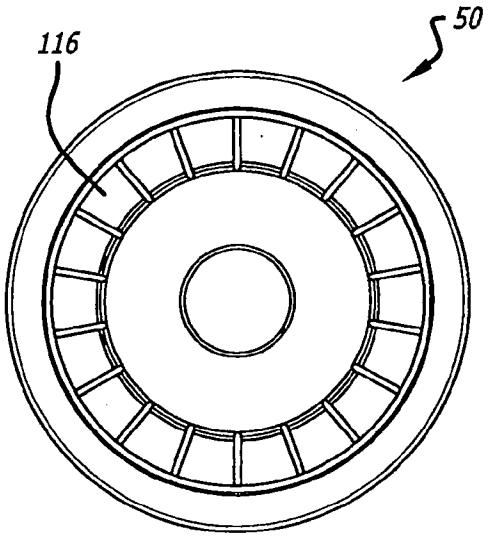
FIG. 15 is a top plan view of the auxiliary breathing flow channel apparatus of FIG. 2.
Figure 18:
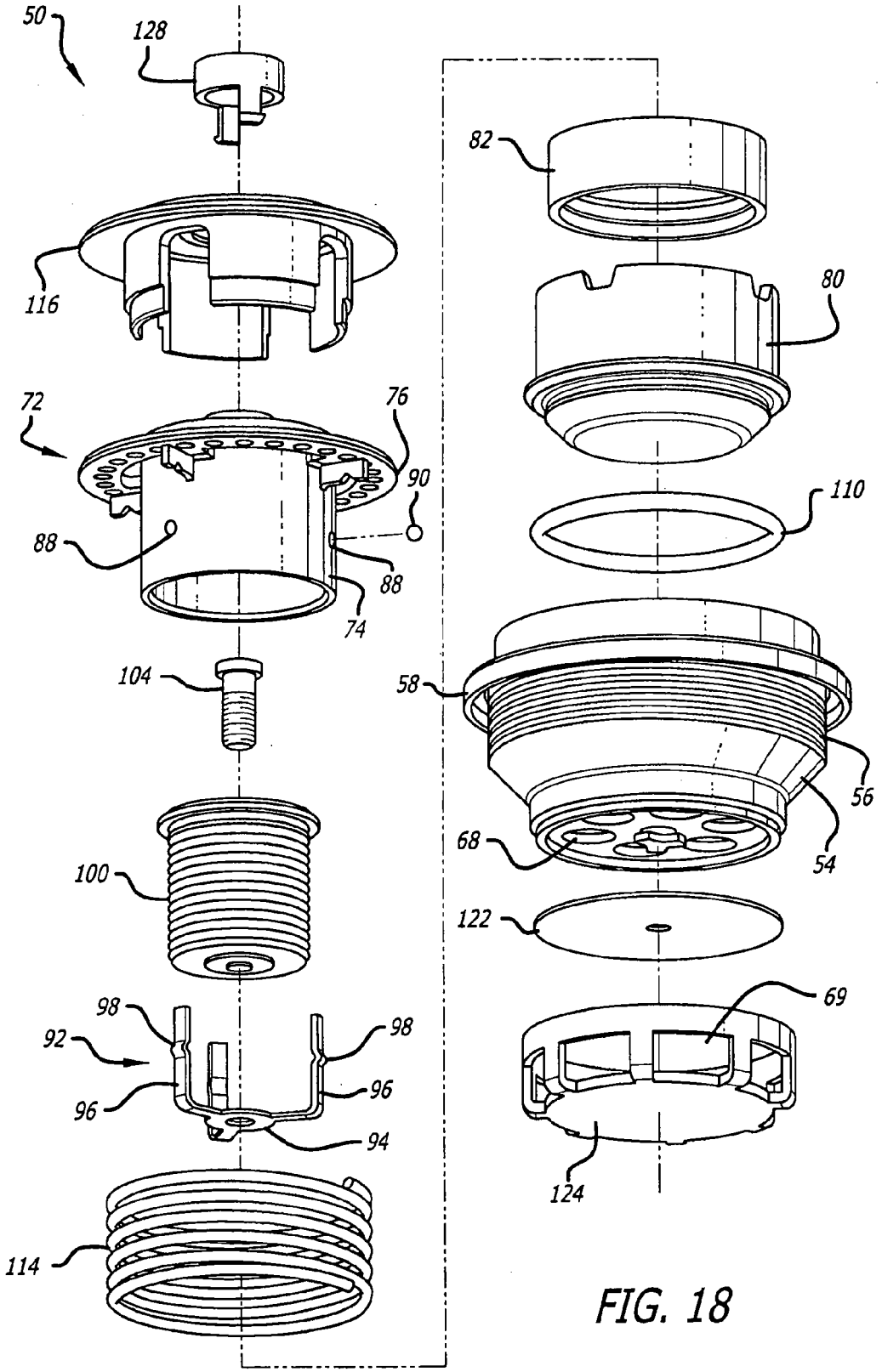
FIG. 18 is an exploded perspective view of the auxiliary breathing flow channel apparatus of FIG. 2.

The auxiliary breathing flow channel 50 includes an air flow regulating valve mechanism 52 having open and closed positions, but normally in an open position at lower altitudes having adequate, life-supporting oxygen levels not requiring the supply of auxiliary oxygen. When the valve mechanism is in an open position, ambient air can be inhaled through the auxiliary breathing flow channel by the user, allowing normal breathing at lower altitudes having breathable, life-supporting oxygen levels. This auxiliary breathing flow channel has a sufficiently low pressure drop that inhalation by the user does not trigger the regulator to dispense stored oxygen during a normal or typical inhalation. As is illustrated in FIGS. 2-4, in one preferred embodiment of the invention, the auxiliary breathing flow channel may be provided as a passage directly through the oronasal face seal of the mask, to entirely bypass the regulator. By opening a passage in the oronasal face seal versus through the regulator, it is possible to obtain the benefits of the present invention while simultaneously continuing to utilize an existing regulator design.

Referring to FIGS. 4, 6, 8 and 10-14, the auxiliary breathing flow channel includes a main or lower housing 54, typically including an outer threaded flow channel connector 56 and flow channel connector flange 58, which may be threadably connectable to a corresponding threaded mask connector port 60 at a side opening 62 of an oxygen mask oronasal face seal, with an o-ring sealing gasket 64 interposed between the mask connector port and the flow channel connector flange to provide a secure leak proof attachment. Referring to FIGS. 6, 8 and 10-14, the main housing includes an inner chamber 66, lower exit ports 68, a lower opening 69, and an upper opening 70 which receives an upper aneroid housing 72 having a generally tubular wall 74 and a top cover plate 76 joined to the tubular wall. The top cover plate includes a plurality of upper vent openings 78 through which ambient air may flow into the auxiliary breathing flow channel to the lower exit ports. The upper aneroid housing is slidingly received in a lower aneroid housing 80 disposed in the inner chamber of the main housing, with a generally annular ball track insert 82 disposed between the walls of the upper aneroid housing and the lower aneroid housing. The inner surface of the ball track insert preferably includes a lower ball track or groove 84, and an upper ball track or groove 86, and the tubular wall of the upper aneroid housing includes a plurality of ball apertures 88, each receiving and retaining a corresponding detent ball 90, such as a stainless steel ball, for example. Typically three stainless steel balls are mounted in three ball apertures.

A spring retainer 92, having a base portion 94 with a plurality of spring fingers 96 connected to and extending from the base portion, is disposed within the upper aneroid housing and lower aneroid housing. The spring fingers have a protrusion 98 aligned with and disposed adjacent to the detent balls to press against and bias the detent balls outwardly into either of the upper or lower ball tracks to latch the upper aneroid housing in an upper or lower position, as will be further explained below. An aneroid capsule 100 is contained within the upper aneroid housing and lower aneroid housing, and the base portion of the spring retainer is connected to a bottom surface 102 of the aneroid, so that when the aneroid expands at elevated altitudes, the bottom surface of the aneroid moves downwardly and the spring fingers of the spring retainer correspondingly are pushed downwardly by the lengthening of the aneroid, releasing pressure on the detent balls to release the detent balls from the lower track of the ball track in the open position of the auxiliary breathing flow channel, and allowing the detent balls to move to the upper track of the ball track in the closed position of the auxiliary breathing flow channel. The operation of the aneroid may be adjusted with an aneroid set point screw 104 threadably mounted in an upper portion of the aneroid.

The lower aneroid housing includes a lower outer shoulder or flange 106 and a channel 108 for receiving and retaining an o-ring 110, located adjacent to the lower inner wall of the main or lower housing, which tapers inwardly to form a valve seating surface 112. A main coil spring 114 is mounted about the lower aneroid housing between the lower flange and the top plate of the top cover plate. A push/pull button, handle or knob 116 having a generally tubular open lower portion 118 and an upper plate 120 connected to the lower portion is mounted with the tubular lower portion situated between the upper aneroid housing and the lower aneroid housing, and abutting the upper surface of the ball track insert. A flapper valve 122 is secured below the lower exit ports by a flapper valve retainer 124. An auxiliary flow channel 126 is thus formed between the inner wall of the main or lower housing and the outer wall of the lower aneroid housing, from the top cover plate upper vent openings to the lower exit ports, through the flapper valve and through the lower opening to the interior of the oronasal cavity of the oxygen mask.

When the auxiliary breathing flow channel is open and operating, typically at or less than approximately 8,000 ft of cabin pressure, the valve mechanism is in a static open position. The spring fingers retain the detent balls in the lower main track of the ball track insert, and the aneroid capsule is fully compressed. When a depressurization occurs, the aneroid capsule will begin to expand at approximately 8,000 ft of cabin pressure. As the aneroid capsule expands, it moves the spring fingers downwardly with the movement of the bottom surface of the aneroid, allowing the detent balls to move down a ramp provided by the spring fingers. The aneroid capsule will typically start moving before approximately 8,000 ft of cabin pressure, but the engagement of the spring fingers and detent balls will not decrease until approximately 8,000 ft. This movement of the detent balls releases the detent balls from the positive engagement of the stainless steel balls in the ball track insert. Before a threshold depressurization at approximately 10,000 ft of cabin altitude is reached, the engagement goes to zero, and the main spring forces closed the aneroid housing assembly at the interface between the o-ring and the main or lower housing. The entire aneroid housing, including the push/pull knob, moves to the closed position, excluding the upper aneroid housing, which is attached to the main housing. In this position, the device cannot be opened using the push/pull button until the aneroid is back on stop, i.e. under approximately 8,000 ft of cabin altitude. The detent balls lock in the upper or secondary groove in the ball track insert to ensure a positive locking position, automatically closing the valve mechanism, based upon use of the aneroid capsule as an altitude sensing device. Other altitude sensing devices may be employed, such as a pressure transducer, or a bourdon tube, for example.

The auxiliary breathing flow channel can also be opened or closed manually under approximately 8,000 ft of cabin altitude. To manually move the valve mechanism from the open position to the closed position the push/pull button is pushed until the spring fingers deflect past the engagement point with the detent balls. The main spring along with this applied pushing force close the valve mechanism. This procedure is very quick to perform, such as in the event of presence of toxic gas or smoke in the cabin, for example. This design also incorporates a tactile set point adjustment screw cap or button 128, which is flush with the push/pull button when the device is in the open position, and taller than the push/pull button when the device is closed, to allow the operator to feel the auxiliary breathing flow channel to ensure that the valve mechanism is closed.

The flapper valve assembly is designed to open upon inhalation and close when the user exhales. This helps keep moisture out of the device, and forces the exhalation from the user out through the exhalation vent in the crew mask dilution demand regulator. In addition, when the dilution demand regulator is switched to the emergency mode providing positive pressure in the mask, the flapper valve closes to act as a secondary seal to ensure no infiltration through the device. The flapper is also designed to be the primary seal in the event the device is still in the open position and the dilution demand regulator is switched to the emergency mode and the device is still in the open position. This is a redundancy built into the device to ensure operator safety.

It will be apparent from the foregoing that while particular forms of the invention have been illustrated and described, various modifications can be made without departing from the spirit and scope of the invention. Accordingly, it is not intended that the invention be limited, except as by the appended claims.

We claim:

1. An auxiliary breathing flow channel apparatus for an oxygen mask for pilots and crew of an airplane, the oxygen mask having an oronasal face seal defining an oronasal cavity, and an oxygen supply regulator, the auxiliary breathing flow channel apparatus comprising:

an ambient air flow channel defined through a portion of the oxygen mask, said ambient air flow channel being connected to ambient air and configured to deliver ambient air through said ambient air flow channel to the oxygen mask;

a flow regulating mechanism configured to regulate flow through the air flow channel, the flow regulating mechanism being movable between at least one closed position in which flow through the ambient air flow channel is blocked and an open position in which flow through the ambient air flow channel is enabled;

an aneroid capsule configured to apply a biasing force to the flow regulating mechanism to maintain the flow regulating mechanism in the at least one closed position;

an upper aneroid housing and a lower aneroid housing disposed in the upper aneroid housing, said aneroid capsule being disposed in said upper and lower aneroid housings, said upper and lower aneroid housings being configured to move the flow regulating mechanism between said open position and said at least one closed position; and a spring retainer configured to latch said upper aneroid housing in upper and lower positions, wherein said aneroid capsule is configured to sense ambient pressure, said aneroid capsule being connected to said spring retainer and being operative to release the spring retainer upon sensing of a decrease in cabin pressure to a threshold pressure, to allow the flow regulating mechanism to revert to the closed position without intervention or action by a user upon such a decrease in cabin pressure.

* * * * *